US009863312B2

(12) United States Patent
Nishikawa et al.

(10) Patent No.: US 9,863,312 B2
(45) Date of Patent: Jan. 9, 2018

(54) INTERNAL COMBUSTION ENGINE AND MANUFACTURING METHOD THEREFOR

(71) Applicant: TOYOTA JIDOSHA KABUSHIKI KAISHA, Toyota-shi, Aichi-ken (JP)

(72) Inventors: Naoki Nishikawa, Miyoshi (JP); Hiroshi Makino, Nagoya (JP); Reona Takagishi, Miyoshi (JP); Akio Kawaguchi, Shizuoka-ken (JP); Yoshifumi Wakisaka, Nagakute (JP); Fumio Shimizu, Nagakute (JP); Toshio Horie, Nagakute (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 35 days.

(21) Appl. No.: 14/910,320

(22) PCT Filed: Jul. 30, 2014

(86) PCT No.: PCT/IB2014/001412
§ 371 (c)(1),
(2) Date: Feb. 5, 2016

(87) PCT Pub. No.: WO2015/019145
PCT Pub. Date: Feb. 12, 2015

(65) Prior Publication Data

US 2016/0177818 A1 Jun. 23, 2016

(30) Foreign Application Priority Data

Aug. 5, 2013 (JP) ..... 2013-162594

(51) Int. Cl.
*F02B 77/11* (2006.01)
*C25D 11/04* (2006.01)
(Continued)

(52) U.S. Cl.
CPC ..... *F02B 77/11* (2013.01); *C22C 21/02* (2013.01); *C22C 21/06* (2013.01); *C25D 11/04* (2013.01);
(Continued)

(58) Field of Classification Search
CPC ..... F02B 77/11; C22C 21/02; C22C 21/06; C25D 11/04; C25D 11/18; C25D 11/246; F02F 1/24; F02F 3/12; F05C 2203/0869
(Continued)

(56) References Cited

U.S. PATENT DOCUMENTS 6,672,917 B2 * 1/2004 Matsuda ..... C25D 11/246 148/247
2003/0001274 A1 * 1/2003 Den ..... B82Y 10/00 257/761
(Continued)

FOREIGN PATENT DOCUMENTS

CN 103080386 A 5/2013
JP 58-192949 A 11/1983
(Continued)

OTHER PUBLICATIONS

International Search Report for PCT/IB2014/001412 dated Mar. 9, 2015.

*Primary Examiner* — Marguerite McMahon
(74) *Attorney, Agent, or Firm* — Sughrue Mion, PLLC

(57) ABSTRACT

In an internal combustion engine in which an anodic oxide film (10) is formed on part or all of a wall surface facing a combustion chamber, the anodic oxide film (10) has a thickness of 30 μm to 170 μm, the anodic oxide film (10) has first micropores (1*a*) having a micro-size diameter, nanopores having a nano-size diameter and second micropores (1*b*) having a micro-size diameter, the first micropores (1*a*) and the nanopores extending from a surface of the anodic
(Continued)

oxide film (10) toward an inside of the anodic oxide film (10) in a thickness direction of the anodic oxide film (10) or substantially the thickness direction, the second micropores (1*b*) being provided inside the anodic oxide film (10), at least part of the first micropores (1*a*) and the nanopores are sealed with a seal (2) converted from a sealant (2), and at least part of the second micropores (1*b*) are not sealed.

8 Claims, 15 Drawing Sheets

(51) Int. Cl.

| | |
|---|---|
| ***C25D 11/24*** | (2006.01) |
| ***F02F 3/12*** | (2006.01) |
| ***C22C 21/02*** | (2006.01) |
| ***C22C 21/06*** | (2006.01) |
| ***C25D 11/18*** | (2006.01) |
| ***F02F 1/24*** | (2006.01) |

(52) U.S. Cl.
CPC ..... *C25D 11/18* (2013.01); *C25D 11/246* (2013.01); *F02F 1/24* (2013.01); *F02F 3/12* (2013.01); *F05C 2203/0869* (2013.01)

(58) Field of Classification Search
USPC ..... 123/668
See application file for complete search history.

(56) References Cited

U.S. PATENT DOCUMENTS

| | | | | |
|---|---|---|---|---|
| 2006/0037866 | A1* | 2/2006 | Yamamoto | C25D 11/024 205/324 |
| 2011/0177355 | A1* | 7/2011 | Ohmi | C22C 21/00 428/544 |
| 2011/0284383 | A1* | 11/2011 | Cabot | C23C 22/74 205/50 |
| 2012/0042859 | A1 | 2/2012 | Sakai | |
| 2013/0146041 | A1 | 1/2013 | Hijii et al. | |
| 2014/0044588 | A1* | 2/2014 | Asano | C22C 21/08 420/532 |
| 2014/0083861 | A1* | 3/2014 | Askin | C25D 11/04 205/202 |
| 2014/0245994 | A1 | 9/2014 | Nishikawa et al. | |

FOREIGN PATENT DOCUMENTS

| | | | |
|---|---|---|---|
| JP | 2003-211002 | A | 7/2003 |
| JP | 2005-298945 | A | 10/2005 |
| JP | 2010-249008 | A | 11/2010 |
| JP | 2013-060620 | A | 4/2013 |
| WO | 2012/025812 | A2 | 3/2012 |
| WO | 2014/188494 | A1 | 11/2014 |
| WO | 2014/188495 | A1 | 11/2014 |

* cited by examiner (EXAMPLE 2)

NO LONGITUDINAL CRACK

SECOND MICROPORES ARE
NOT SEALED WITH SEALANT (COMPARATIVE EXAMPLE 3)

LONGITUDINAL
CRACK

SEALANT PENETRATES THROUGH
LONGITUDINAL CRACK INTO INTERNAL
DEFECT THAT COMMUNICATES WITH
LONGITUDINAL CRACK, AND SEALS
INTERNAL DEFECT

INTERNAL COMBUSTION ENGINE AND MANUFACTURING METHOD THEREFOR

BACKGROUND OF THE INVENTION

1. Field of the Invention

The invention relates to an internal combustion engine and a manufacturing method therefor and, more particularly, to an internal combustion engine in which an anodic oxide film is formed on part or all of a wall surface facing a combustion chamber of the internal combustion engine and a manufacturing method for an internal combustion engine, which has a characteristic in a method of forming the anodic oxide film.

2. Description of Related Art

An internal combustion engine, such as a gasoline engine and a diesel engine, is mainly formed of an engine block, a cylinder head and a piston. A combustion chamber of the internal combustion engine is defined by a bore face of the cylinder block, a top face of the piston assembled in the bore, a bottom face of the cylinder head and top faces of intake and exhaust valves arranged in the cylinder head. With high-power requirements to recent internal combustion engines, it is important to reduce the cooling losses of the internal combustion engines. As one of measures to reduce the cooling losses, there is a method of forming a heat insulation film made of ceramics on an inner wall of the combustion chamber.

However, because the above-described ceramics generally have a low thermal conductivity and a high thermal capacity, there occurs a decrease in intake efficiency or knocking (abnormal combustion due to remaining of heat in the combustion chamber) due to a steady increase in surface temperature. Therefore, the ceramics have not presently become widespread as a film material for the inner wall of the combustion chamber.

For this reason, the heat insulation film that is formed on the wall surface of the combustion chamber is desirably formed of a material having not only heat resistance and heat insulation properties as a matter of course but also a low thermal conductivity and a low thermal capacity. That is, in order not to increase the wall temperature steadily, the film should have a low thermal capacity in order to reduce the wall temperature following a fresh air temperature in an intake stroke. Furthermore, in addition to the low thermal conductivity and low thermal capacity, the film is desirably formed of a material that can resist against explosion pressure at the time of combustion in the combustion chamber, injection pressure, and repeated stress of thermal expansion and thermal shrinkage and that has a high adhesion to a base material, such as the cylinder block.

Focusing on an existing known technique, Japanese Patent Application Publication No. 58-192949 (JP 58-192949 A) describes a piston, in which an alumite layer is formed on a top face and a ceramic layer is formed on the surface of the alumite layer, and a manufacturing method for the piston. With this piston, the alumite layer is formed on the top face, so the piston has an excellent heat resistance property and an excellent heat insulation property.

In this way, with the alumite layer (anodic oxide film) formed on a wall surface facing a combustion chamber of an internal combustion engine, it is possible to form the internal combustion engine having an excellent heat insulation property, a low thermal conductivity and a low thermal capacity. In addition to these capabilities, an excellent swing characteristic is also an important capability that is required for the anodic oxide film. The "swing characteristic" is a characteristic that the temperature of the anodic oxide film follows the gas temperature in the combustion chamber although the anodic oxide film has a heat insulation capability.

Incidentally, when the above-described anodic oxide film is observed microscopically, the anodic oxide film has such a structure that a large number of cells are adjacent to each other, a large number of cracks are present on the surface of the anodic oxide film, part of the cracks extend inward (that is, in the thickness direction of the anodic oxide film or substantially the thickness direction), and a large number of internal defects extending in a direction different from the thickness direction (a horizontal direction perpendicular to the thickness direction or substantially the horizontal direction) are present in the film. The inventors, et al. identified that these cracks and internal defects are micropores having a micro-size diameter (or a maximum diameter in cross section) of about the range of 1 μm to 100 μm. The "cracks" are originated from crystallized products of casting aluminum alloy.

There are also a large number of small pores (nanopores) having a nano-size diameter inside the anodic oxide film in addition to the above-described micro-size cranks and internal defects. Generally, the nanopores are also present so as to extend from the surface of the anodic oxide film in the thickness direction of the anodic oxide film or substantially the thickness direction. The "nanopores" are originated from anodizing and are regularly arranged.

In this way, the anodic oxide film to be formed generally has micropores, such as surface cracks and internal defects having a micro-size diameter or maximum size in cross section and a large number of nano-size nanopores.

The inventors, et al. describe a technique that relates to an internal combustion engine in which an anodic oxide film having a low thermal conductivity, a low thermal capacity, an excellent heat insulation property and an excellent switch characteristic is provided on part or all of a wall surface facing a combustion chamber and a manufacturing method for the internal combustion engine in Japanese Patent Application Publication No. 2013-060620 (JP 2013-060620 A). More specifically, a large number of nanopores are formed in a state where a sealant does not penetrate into the nanopores by applying porous sealing treatment to nano-size small pores present inside the anodic oxide film formed on the wall surface facing the combustion chamber, thus keeping at least part of the nanopores from being sealed. Subsequently, a sealant is applied to relatively large micro-size gaps, thus sealing at least part of the gaps with a seal converted from the above sealant. Thus, an internal combustion engine in which the anodic oxide film having an excellent heat insulation property, a high strength and an excellent swing characteristic is provided on part or all of the wall surface facing the combustion chamber.

With the internal combustion engine and the manufacturing method therefor, described in JP 2013-060620 A, a predetermined porosity is ensured because the nanopores are not sealed, and this guarantees the heat insulation property. However, it is difficult to ensure a sufficient porosity, because pores that are not seated are nanopores. Therefore, it is required to increase the thickness of the anodic oxide film in order to guarantee the heat insulation property. For example, it is possible to form an anodic oxide film having an excellent heat insulation property by setting the thickness of the anodic oxide film to about 300 to 500 μm; however, forming an anodic oxide film having such a thickness takes a manufacturing time, causing an increase in manufacturing cost.

SUMMARY OF THE INVENTION

The invention provides an internal combustion engine in which an anodic oxide film having a low thermal conductivity, a low thermal capacity, an excellent heat insulation property, an excellent swing characteristic and a maximally thin thickness is provided on part or all of a wall surface facing a combustion chamber, and a manufacturing method for the internal combustion engine.

A first aspect of the invention provides an internal combustion engine in which an anodic oxide film is formed on part or all of an aluminum-based wall surface facing a combustion chamber. In the internal combustion engine, the anodic oxide film has a thickness of 30 μm to 170 μm, the anodic oxide film has first micropores having a micro-size diameter, nanopores having a nano-size diameter and second micropores having a micro-size diameter, the first micropores and the nanopores extending from a surface of the anodic oxide film toward an inside of the anodic oxide film in a thickness direction of the anodic oxide film or substantially the thickness direction, the second micropores being provided inside the anodic oxide film, at least part of the first micropores and the nanopores are sealed with a seal that is converted from a sealant, and at least part of the second micropores are not sealed.

The internal combustion engine according to the first aspect of the invention includes the anodic oxide film (or a heat shield film) on part or all of the combustion chamber. However, at least part of the first micropores having a micro-size diameter and the nanopores having a nano-size diameter, extending from the surface of the anodic oxide film toward the inside of the anodic oxide film in the thickness direction of the anodic oxide film or substantially the thickness direction, are sealed; whereas at least part of the second micropores present inside the film are not sealed. Thus, the anodic oxide film is allowed to have a high porosity even with a small thickness and have a high heat insulation property. In this way, when at least part of the first, micropores and the nanopores are sealed with the seal, it is possible to suppress entry of high-temperature high-pressure combustion gas in the engine cylinder into the inside of the film. If it is not possible to suppress entry of combustion gas into the inside of the film, heat insulation effect reduces at a portion to which gas has entered, so heat insulation effect decreases as the whole film. On the other hand, when sealed as described above, it is possible to suppress entry of combustion gas into the inside of the film, so it is possible to exercise the original heat insulation capability of the film without impairment.

Here, the "first micropores" mean cracks extending from the surface of the anodic oxide film to the inside of the anodic oxide film, and the "second micropores" mean internal defects not present at the surface of the anodic oxide film but present inside the film.

The phrase "at least part of the first micropores and the nanopores are sealed with a seal that is converted from a sealant" means not only a mode in which all the first micropores having a micro-size diameter and the nanopores having a nano-size diameter, present in the anodic oxide film, are sealed with a seal but also, for example, a mode in which the first micropores and the nanopores present within the range from the surface layer of the anodic oxide film to a certain depth are sealed, and the first micropores and the nanopores present within the range deeper than that depth are not sealed.

The phrase "at least part of the second micropores are not sealed" means not only a mode in which all the second micropores having a micro-size diameter, present in the anodic oxide film, are not sealed but also, for example, the second micropores present within the range from the surface layer of the anodic oxide film to a certain depth are sealed and the second micropores present within the range deeper than that depth are not sealed or a mode in which the surroundings of the second micropores are covered with a seal and the insides of the micropores are not filled with a seal.

In the anodic oxide film according to the mode in which all the second micropores not provided at the surface layer of the film but present inside the film are not sealed, the anodic oxide film is able to ensure a high porosity and an excellent heat insulation property; however, actually, the sealant also penetrates into the second micropores that communicate with the first micropores or the nanopores, facing the surface of the film, and those second micropores are sealed with a seal.

The first micropores and the nanopores extend in the thickness direction of the anodic oxide film or substantially the thickness direction. Here, "substantially the thickness direction" means to include, for example, a mode in which the first micropores and the nanopores extend in a direction inclined with respect to the thickness direction and a mode in which the first micropores and the nanopores extend in a zigzag shape with respect to the thickness direction.

On the other hand, the second micropores, for example, include a mode in which the second micropores extend in a direction perpendicular to the thickness direction of the anodic oxide film inside the anodic oxide film, a mode in which the second micropores extend in a direction inclined with respect to the direction perpendicular to the thickness direction and a mode in which the second micropores extend in a zigzag shape with respect to the direction perpendicular to the thickness direction.

In the specification, the "diameter" of each of the first micropores, each of the nanopores, or the like, literally means a diameter in the case of a cylindrical columnar shape, and means a side having a maximum size in cross section in the case of an elliptical columnar shape or a prismatic shape. Thus, for pores having a shape other than the cylindrical columnar shape, the "diameter" is read as "diameter of a circle having an equivalent area".

The word "seals" the micropores or the nanopores means that a sealant is, for example, applied to cracks or internal defects that constitute the micropores or the nanopores and the cracks or the internal defects are buried with the seal, which is converted from the sealant, to be closed. Particularly, the second micropores, as already described above, mean that the surroundings of the micropores are covered with a seal and the insides of the micropores are not filled with a seal. The "sealant" is a coating material including an inorganic substance, and the "seal" is a substance that is converted from the coating material containing the inorganic substance. According to the inventors, the diameter or maximum size of the cross section of each of the micro-size micropores provided in the anodic oxide film formed on the wall surface facing the combustion chamber of the internal combustion engine is generally identified to fall within the range of about 1 to 100 μm, and the diameter or maximum size of the cross section of each of the nano-size nanopores is generally identified to fall within the range of about 10 to 100 nm.

The above-described identification of the range of 1 to 100 μm and the range of 10 to 100 nm may be carried out as follows. Micropores and nanopores within a specified area are respectively extracted from SEM image photograph data and TEM image photograph data of the cross section of the anodic oxide film, the diameters or the maximum sizes of the extracted micropores and nanopores are measured, and the respective averages are obtained. Thus, the sizes are identified.

The internal combustion engine according to the invention may be intended for any one of a gasoline engine and a diesel engine. As already described above, the internal combustion engine is mainly formed of an engine block, a cylinder head and a piston. The combustion chamber of the internal combustion engine is defined by a bore face of the cylinder block, a top face of the piston assembled in the bore, a bottom face of the cylinder head and top faces of intake and exhaust valves arranged in the cylinder head.

The above-described anodic oxide film may be formed on all of the wall surface facing the combustion chamber or may be formed on only part of the wall surface. In the latter case, for example, the film may be formed on only the top face of the piston or only the valve top faces.

A base material that constitutes the combustion chamber of the internal combustion engine may be aluminum, an aluminum alloy, an aluminized iron-based material. The anodic oxide film that is formed on the wall surface is an alumite.

With the internal combustion engine according to the invention, part or all of the micro-size second micropores are not sealed, so the anodic oxide film has a high porosity and an excellent heat insulation property even with a thickness of 30 μm to 170 μm, that is, a relatively small thickness.

Here, the anodic oxide film sealed with the seal may have a porosity of 20 to 70%.

According to the inventors, it is known that the ratio of micropores to nanopores in the anodic oxide film is about 3:1. As a result of prototyping various test pieces, a breakdown of the porosity in the range of 20 to 70% is that the first and second micropores occupy 20 to 50% and the nanopores occupy 0 to 20%. With the configuration that all or part of the micro-size second micropores are not sealed, it is possible to ensure the porosity in the range of 20 to 70%, so the internal combustion engine includes the anodic oxide film having a high heat insulation property.

The seal may be made of a substance that includes silica as a main component.

The sealant that forms the seal may be any one of polysiloxane, polysilazane and sodium silicate. Among others, polysiloxane or polysilazane, which is a coating material having a viscosity that allows smooth penetration into the micropores or nanopores in the anodic oxide film and containing a room-temperature curing inorganic substance that is able to cure without high-temperature heating (firing) and that provides an extremely high hardness seal obtained by curing.

An aluminum-based material that forms the aluminum-based wall surface of the internal combustion engine may contain at least one of Si, Cu, Mg, Ni, and Fe as an alloy component.

Si, Cu, Mg, Ni, and Fe are identified by the inventors as elements that contribute to enlargement of micropores in the anodic oxide film. Particularly, enlargement of the second micropores leads to ensuring a high porosity.

A second aspect of the invention provides a manufacturing method for an internal combustion engine in which an anodic oxide film is formed on part or all of an aluminum-based wall surface facing a combustion chamber. The manufacturing method includes a first step of forming the anodic oxide film on part or all of the aluminum-based wall surface, the anodic oxide film having first micropores having a micro-size diameter, nanopores having a nano-size diameter and second micropores having a micro-size diameter, the first micropores and the nanopores extending from a surface of the anodic oxide film toward an inside of the anodic oxide film in a thickness direction of the anodic oxide film or substantially the thickness direction, the second micropores being provided inside the anodic oxide film, the anodic oxide film having a thickness of 30 μm to 170 μm; and a second step of forming the anodic oxide film subjected to sealing in which a sealant is applied to the surface of the anodic oxide film, the sealant penetrates into at least part of the first micropores and the nanopores, the sealant is converted into a seal, at least part of the first micropores and the nanopores are sealed with the seal and at least part of the second micropores are not sealed.

Here, the sealant may be polysiloxane, polysilazane, or the like, as already described above. By using one of these, it is possible to relatively smoothly penetrate the sealant into the small micro-size or nano-size pores, it is possible to convert the sealant into silica at a relatively low temperature, and it is possible to improve the strength of the anodic oxide film after curing of the sealant into a cured product (for example, silica glass) having a high hardness.

A method of applying the sealant is not specifically limited; however, the method of applying the sealant may be a method of dipping the anodic oxide film in a sealant, a method of spraying the sealant to the surface of the anodic oxide film, blade coating, spin coating, brush coating, or the like.

The anodic oxide film to be manufactured may have a porosity of 20 to 70% as already described above.

An aluminum-based material that forms the aluminum-based wall surface of the internal combustion engine may contain at least one of Si, Cu, Mg, Ni, and Fe as an alloy component.

With the manufacturing method according to the invention, at least the first micropores and the nanopores are sealed with the sealant, so the internal combustion engine including the anodic oxide film having a high hardness is obtained.

Because the anodic oxide film has a thickness of 30 μm to 170 μm, that is the anodic oxide film, is relatively thin, a time required to form the anodic oxide film may be short, with the result that it is possible to reduce manufacturing cost.

According to the inventors, for example, in a small-sized supercharging direct-injection diesel engine for a passenger car, at an optimal fuel economy point equivalent to a state where the engine rotation speed is 2100 rpm and the average effective pressure is 1.6 MPa, improvement of 5% in fuel economy is estimated to be obtained at the maximum. The 5% fuel economy improvement is a value that can be proved as a distinctly significant difference and that is not buried as a measurement error at the time of an experiment. At the same time with fuel economy, improvement, the exhaust gas temperature is estimated to increase by about 15° C. because of heat shielding. The increase in the exhaust gas temperature is effective in reducing a warm-up time of NOx reduction catalyst immediately after starting in an actual machine, and is a value by which improvement in NOx purification rate and a reduction in NOx are confirmed.

On the other hand, in the cooling test (rapid cooling test) that is performed at the time of evaluating the swing characteristic of the anodic oxide film, the test piece to which the anodic oxide film is applied is used only for one-side face, the front face temperature of the test piece is reduced by jetting cooling air having a predetermined temperature to the front face (a face to which the anodic oxide film is applied) of the test piece while the back face (a face to which no anodic oxide film is applied) is continuously heated with predetermined high-temperature jet, the temperature is measured, a cooling curve formed of a, film surface temperature and a time is created, and a temperature drop rate is evaluated. The temperature drop rate is, for example, such that a time required for the film surface temperature to decrease by 40° C. is read from the graph and is evaluated as a 40° C.-drop time.

The rapid cooling test is conducted on a plurality of test, pieces, a 40° C.-drop time is measured for each of the test pieces, and an approximate curve regarding a plurality of plots defined by a fuel economy improvement rate and a 40° C.-drop time is created.

When the value of 40° C.-drop time, corresponding to the above-described 5% fuel economy improvement rate, is read, the fact that 40° C.-drop time is 45 msec is identified by the inventors. As the 40° C.-drop time shortens, the thermal conductivity and thermal capacity of the film decrease, and the fuel economy improvement effect increases.

As can be understood from the above description, with the internal combustion engine and the manufacturing method therefor according to the invention, at least part of the first micropores having a micro-size diameter and the nanopores having a nano-size diameter, extending from the surface of the anodic oxide film toward the inside of the anodic oxide film in the thickness direction of the anodic oxide film or substantially the thickness direction, are sealed with the seal, whereas at least part of the second micropores present inside the film are not sealed. Therefore, it is possible to provide the internal combustion engine including the anodic oxide film having a high porosity, and a high heat insulation property even when the thickness is small.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, an internal combustion engine and a manufacturing method therefor according to an embodiment of the invention will be described with reference to the accompanying drawings. In an illustrated example, an anodic oxide film is formed on all of the wall surface facing a combustion chamber of the internal combustion engine. However, the anodic oxide film may be formed only on part of the wall surface facing the combustion chamber, such as only a top face of a piston and only a top surface of a valve.

Embodiment of Internal Combustion Engine and Manufacturing Method Therefor

Figure 1:
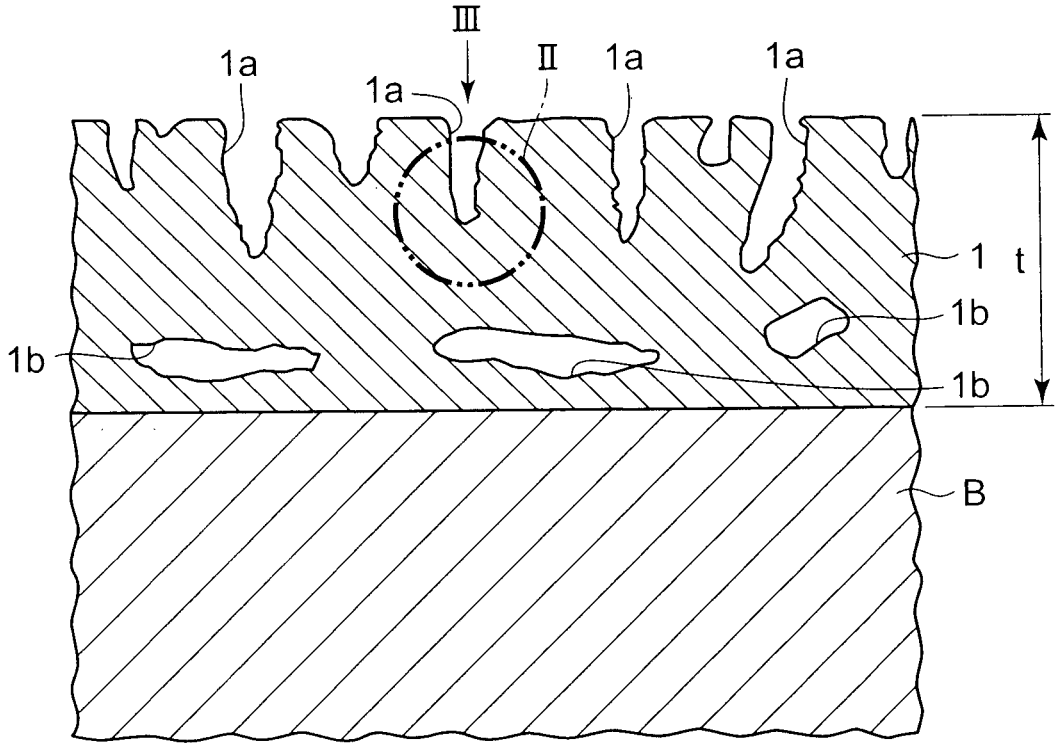
FIG. 1 is a longitudinal cross-sectional view that schematically shows a state before micropores and nanopores are sealed in an anodic oxide film formed on a wall surface facing a combustion chamber of an internal combustion engine according to an embodiment of the invention.
Figure 2:
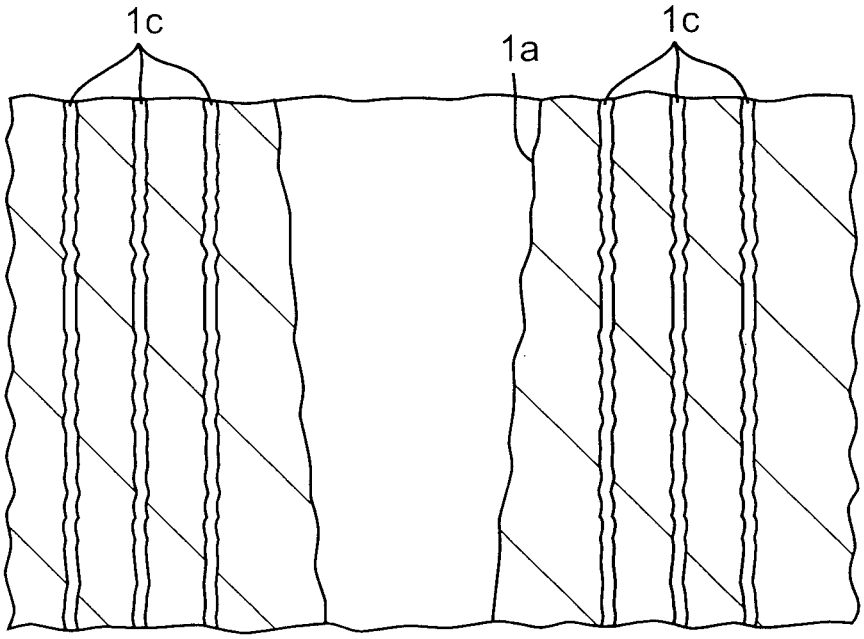
FIG. 2 is an enlarged view of portion II in FIG. 1.
Figure 3:
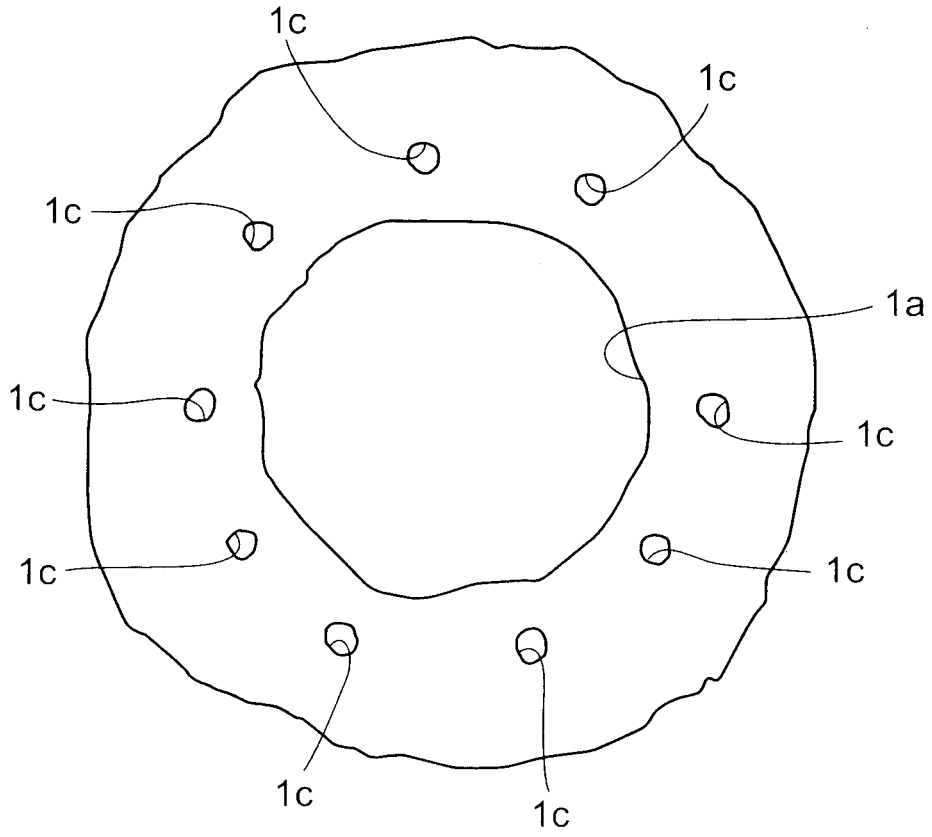
FIG. 3 is a view in the arrow III direction in FIG. 1.
Figure 5:
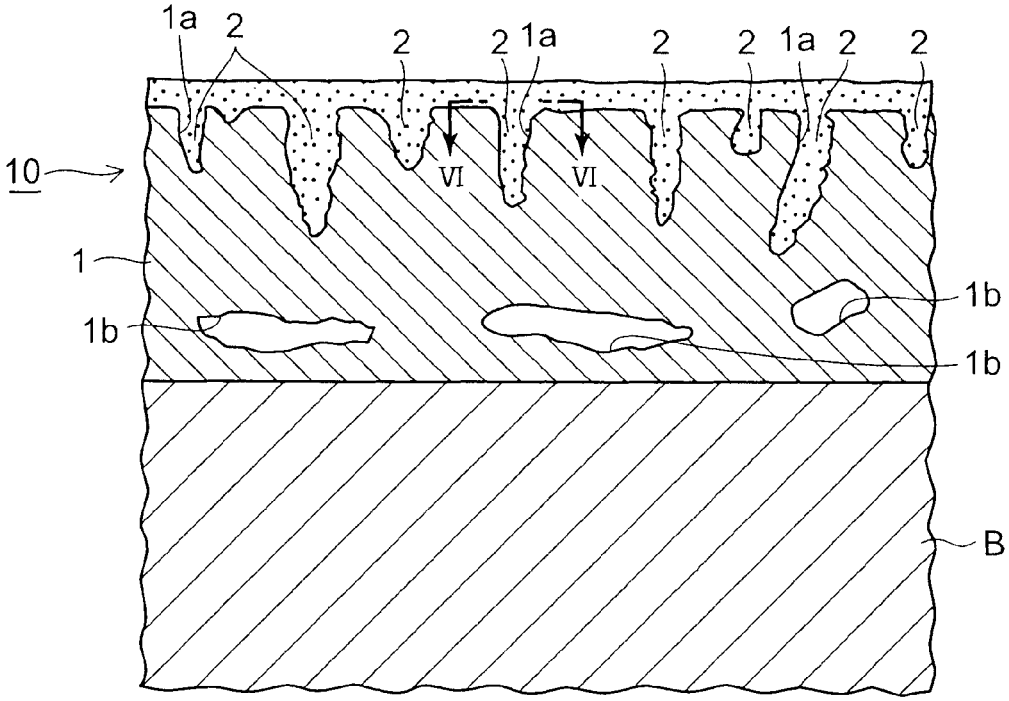
FIG. 5 is a view that illustrates an anodic oxide film formed by a manufacturing method for an internal combustion engine according to the embodiment of the invention.

FIG. 1 and FIG. 5 show the flow diagram of the manufacturing method for an internal combustion engine in the stated order. More specifically, FIG. 1 is a longitudinal cross-sectional view that schematically shows a state before micropores and nanopores are sealed in the anodic oxide film formed on the wall surface facing the combustion chamber of the internal combustion engine according to the invention. FIG. 2 is an enlarged view of portion II in FIG. 1. FIG. 3 is a view in the arrow III direction in FIG. 1.

Initially, an anodic oxide film 1 is formed by applying anodizing to an aluminum-based wall surface B facing the combustion chamber of the internal combustion engine (not shown). That is, the internal combustion engine is mainly formed of an engine block, a cylinder head and a piston. The combustion chamber of the internal combustion engine is defined by a bore face of the cylinder block, a top face of the piston assembled in the bore, a bottom face of the cylinder head and top faces of intake and exhaust valves arranged in the cylinder head. The anodic oxide film to be formed is formed on all of the wall surface facing the combustion chamber.

The aluminum-based wall surface B that constitutes the combustion chamber of the internal combustion engine may be, for example, formed by anodizing aluminum, an aluminum alloy or an aluminized iron-based material. The anodic oxide film that is formed on the wall surface made of aluminum or an aluminum alloy as a base material is an alumite.

As shown in FIG. 1, when the anodic oxide film 1 formed on the surface of the aluminum-based wall surface B that constitutes the wall surface of the combustion chamber is observed microscopically, first micropores 1*a* (longitudinal cracks), are present on the surface of the anodic oxide film 1, and second micropores 1*b* (internal defects) are present inside the anodic oxide film 1. The first micropores 1*a* extend in the thickness direction of the anodic oxide film 1 or substantially the thickness direction and have a micro-size diameter. The second micropores 1*b* extend in the horizontal direction of the anodic oxide film 1 or substantially the horizontal direction and have a micro-size diameter.

These first micropores 1*a* and second micropores 1*b* have a sectional diameter or maximum size of the range of about 1 to 100 μm. When not an ordinary aluminum alloy but an aluminum alloy contains at least one of Si, Cu, Mg, Ni, Fe as compared to the ordinary aluminum alloy, the diameter or sectional size of each micropore tends to further increase.

As shown in FIG. 2 and FIG. 3, other than the first and second micropores 1*a*, 1*b*, a large number of nano-size small pores (nanopores 1*c*) are also present inside the anodic oxide film 1. The nanopores 1*c*, as well as the first micropores 1*a*, extend in the thickness direction of the anodic oxide film 1 or substantially the thickness direction. The diameter or maximum size of the cross section of each of the nanopores 1*c* ranges from about 10 to 100 nm.

A manufacturing method for an internal combustion engine according to the embodiment of the invention is intended to form the maximally thin anodic oxide film having an excellent heat insulation property on the wall surface facing the combustion chamber of the internal combustion engine. Specifically, in the manufacturing method, the first micropores 1*a* and the nanopores 1*c* facing the surface of the film are sealed with a sealant, but the second micropores 1*b* present inside the film are not sealed. Thus, the film has a high porosity, so the film having an excellent heat insulation property is manufactured although the film is a thin layer.

Therefore, the thin-layer anodic oxide film 1 having a thickness t of 30 μm to 170 μm is formed on the surface of the aluminum-based wall surface B facing the combustion chamber by anodizing (first step).

Because the thickness t of the anodic oxide film 1 formed in the first step is small, the length of each first micropore 1*a* extending in the thickness direction of the film or substantially the thickness direction is also small, so the first micropores 1*a* are hard to communicate with the second micropores 1*b* present inside the film. With this configuration, at the time when a sealant is applied in the following second step, the sealant penetrates into the first micropores 1*a* but does not penetrate into the second micropores 1*b*. Thus, it is possible to suppress the second micropores 1*b* from being sealed with the sealant.

Figure 4:
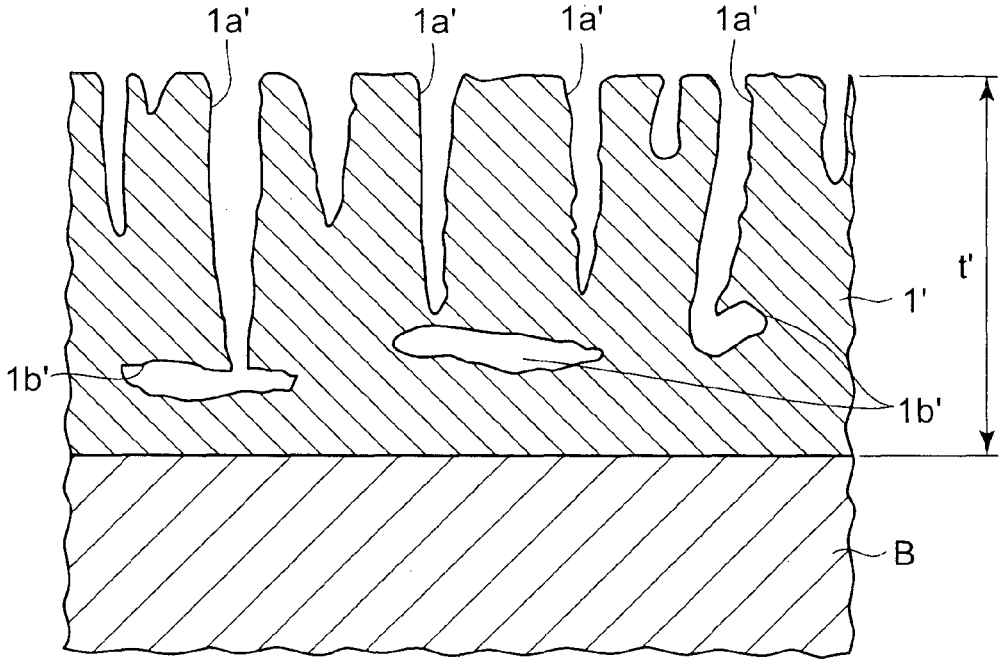
FIG. 4 is a view of an anodic oxide film according to a reference example, which corresponds to FIG. 1.

FIG. 4 shows an anodic oxide film 1' formed on the surface of the aluminum-based wall surface B and having a thickness t' of 300 μm or larger.

As the thickness increases, the length of each of the first micropores 1*a'* that are surface cracks also increases. As a result, the first micropores 1*a'* are easy to communicate with the second micropores 1*b'* present inside the film, and there is a high possibility that the sealant applied in the following second step passes through the first micropores 1*a'* and penetrates into the second micropores 1*b'* to seal the second micropores 1*b'*.

Figure 6:
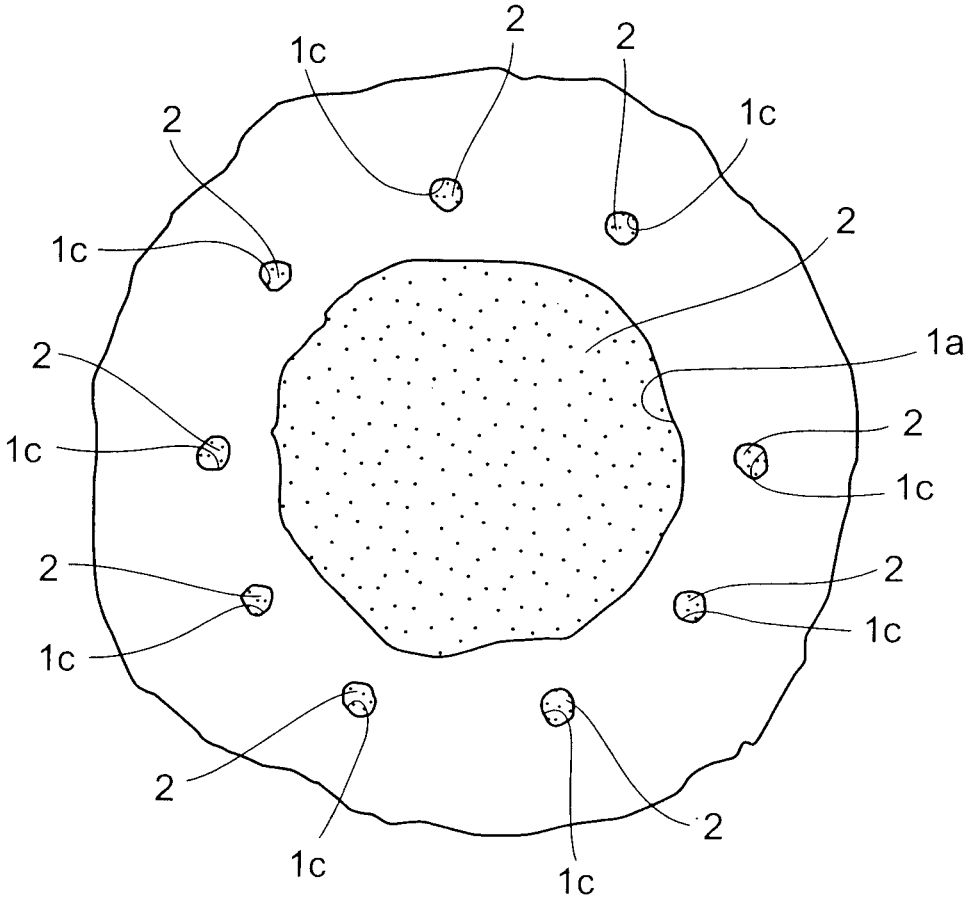
FIG. 6 is a view in the arrow VI direction in FIG. 5.

Subsequently, in the second step, as shown in FIG. 5 and FIG. 6, a sealant 2 is applied to the first micropores 1*a* and the nanopores 1*c* to seal at least part of the first micropores 1*a* and the nanopores 1*c* and not to seal the second micropores 1*b*, not communicating with the first micropores 1*a*, with the sealant 2 as much as possible. Thus, an anodic oxide film 10 applied to sealing treatment of such a structure that the first micropores 1*a* and the nanopores 1*c* are sealed with a seal 2 that is converted from the sealant 2 and the second micropores 1*b* are not sealed or substantially not sealed is formed.

A method of applying the sealant 2 may be a method of dipping the anodic oxide film into a case in which the sealant 2 is contained, a method of spraying the sealant 2 to the surface of the anodic oxide film, blade coating, spin coating, brush coating, or the like.

The sealant 2 may be polysiloxane, polysilazane, or the like. By using one of these, the sealant 2 is allowed to relatively smoothly penetrate into the small first micropores 1*a* or the small nanopores 1*c*, it is possible to convert the sealant 2 into silica at a relatively low temperature, and it is possible to improve the strength of the anodic oxide film 10 after curing of the sealant 2 into a cured product, such as silica glass, having a high hardness.

In this way, because part or all of the micro-size second micropores 1*b* present inside the formed anodic oxide film 10 are not sealed, the anodic oxide film 10 has a high porosity. Therefore, the anodic oxide film 10 has an excellent heat insulation property although the thickness is small, that is, the thickness ranges from 30 μm to 170 μm.

Figure 7:
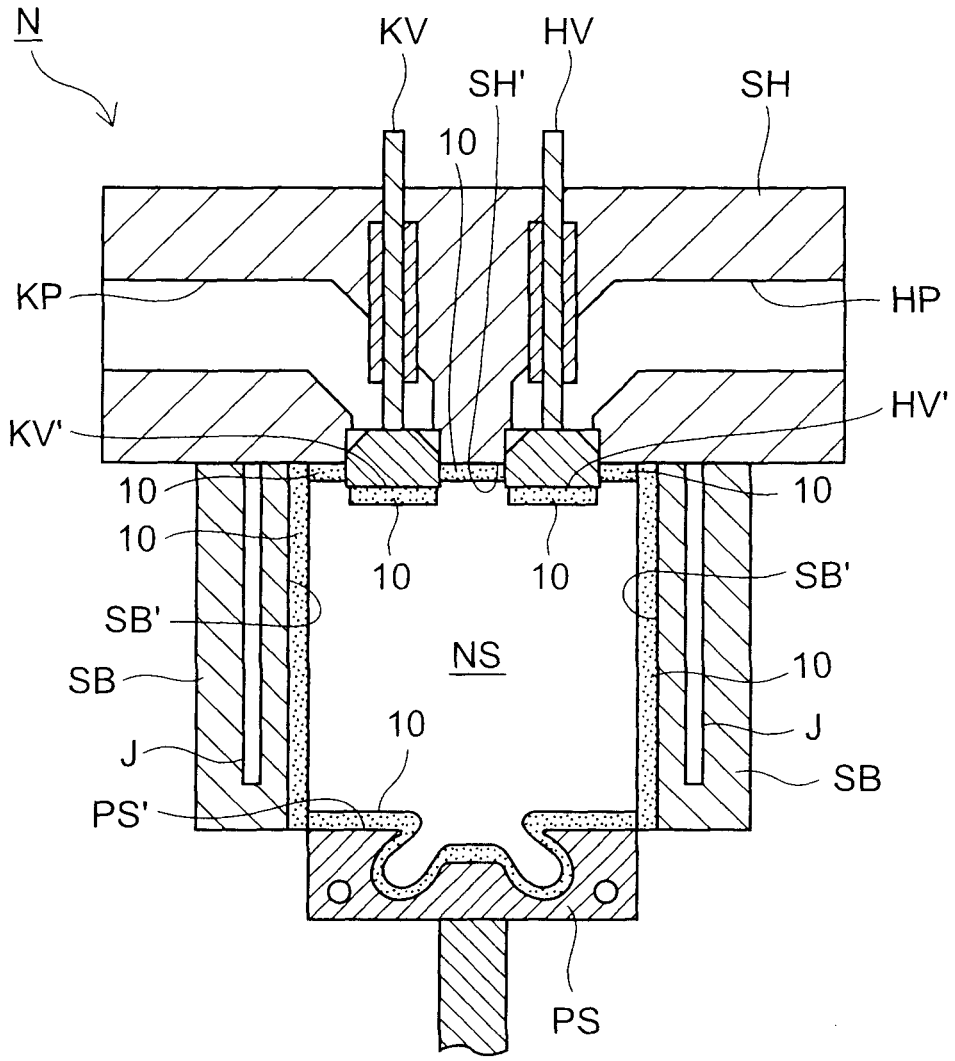
FIG. 7 is a longitudinal cross-sectional view that schematically shows an internal combustion engine in which the anodic oxide film is formed on all of the wall surface facing the combustion chamber.

FIG. 7 schematically shows an internal combustion engine in which the anodic oxide film 10 is formed on all of the wall surface facing the combustion chamber.

The illustrated internal combustion engine N is intended for a diesel engine, and is roughly formed of a cylinder block. SB, a cylinder head SH, an intake port KP, an exhaust port HP, an intake valve KV, an exhaust valve HV, and a piston PS. A coolant jacket J is formed inside the cylinder block SB. The cylinder head SH is arranged on the cylinder block SB. The intake port KP and the exhaust port HP are defined inside the cylinder head SH. The intake valve KV and the exhaust valve HV are respectively installed at openings of which the intake port KP and the exhaust port HP face the combustion chamber NS so as to be movable up and down. The piston PS is provided so as to be movable up and down through a lower opening of the cylinder block SB. Of course, the internal combustion engine according to the invention may be intended for a gasoline engine.

The component members that constitute the internal combustion engine N all are formed of aluminum or an aluminum alloy (including a high-strength aluminum alloy). Particularly, the aluminum material contains at least one of Si, Cu, Mg, Ni, and Fe as an alloy content, so enlargement in the diameter of each micropore is facilitated, and it is possible to improve the porosity.

Inside the combustion chamber NS defined by the component members of the internal combustion engine N, the anodic oxide film 10 is formed on a wall surface (a cylinder bore face SB', a cylinder head bottom face SH', a piston top face PS', and valve top faces KV', HV') at which these component members face the combustion chamber NS. Swing Characteristic Evaluation Test, Strength Evaluation Test and Results of them The inventors manufactured a plurality of test pieces obtained by forming the anodic oxide film on base materials, having component compositions shown in the following Table 1 under the condition shown in Table 2, evaluated the swing characteristic of each anodic oxide film by conducting a cooling test and conducting a strength test at the same time, and obtained the correlation among the thickness, swing characteristic and strength of the anodic oxide film.

TABLE 1

(Each component is indicated in mass %)

| Component | Cu | Si | Mg | Zn | Fe | Mn | Ti | Al |
|---|---|---|---|---|---|---|---|---|
| Alloy 1 | 0 | 12.0 | 0.78 | 0.11 | 0.18 | <0.01 | <0.01 | Remainder |
| Alloy 2 | 0.2 | 12.0 | 0.78 | 0.11 | 0.18 | <0.01 | <0.01 | Remainder |
| Alloy 3 | 0.4 | 12.0 | 0.78 | 0.11 | 0.18 | <0.01 | <0.01 | Remainder |
| Alloy 4 | 0.8 | 12.0 | 0.78 | 0.11 | 0.18 | <0.01 | <0.01 | Remainder |
| Alloy 5 | 0.4 | 0 | 0.78 | 0.11 | 0.18 | <0.01 | <0.01 | Remainder |
| Alloy 6 | 0.4 | 2.0 | 0.78 | 0.11 | 0.18 | <0.01 | <0.01 | Remainder |
| Alloy 7 | 0.4 | 5.0 | 0.78 | 0.11 | 0.18 | <0.01 | <0.01 | Remainder |

TABLE 2

| Electrolytic Solution | Solution Temperature (° C.) | Current Density (mA/cm2) |
|---|---|---|
| 20% Sulfuric Acid | 0 | 60 |

A method of sealing the pores of the anodic oxide film was performed in such a manner that the anodic oxide film is put in boiled pure water for 30 minutes. At the time of forming the anodic oxide film, the sealant was polysilazane, and a polysilazane 20% solution that uses dibutyl ether as a solvent was produced. A method of applying the sealant was performed in the following manner. The solution was applied with a brush on the entire surface of the anodic oxide film having a selected thickness, the applied solution was dried by warm air in several minutes, then the solution was applied with the brush again (this process was repeated five times), and the resultant product was fired in a firing furnace at 180° C. for 8 hours, thus sealing the micropores and nanopores of the anodic oxide film.

Figure 8A:
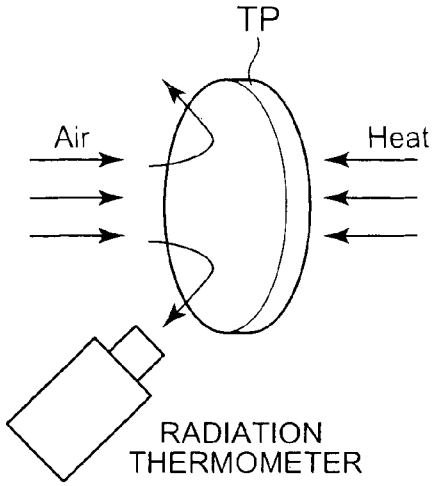
FIG. 8A is a schematic view that illustrates the outline of a cooling test.
Figure 8B:
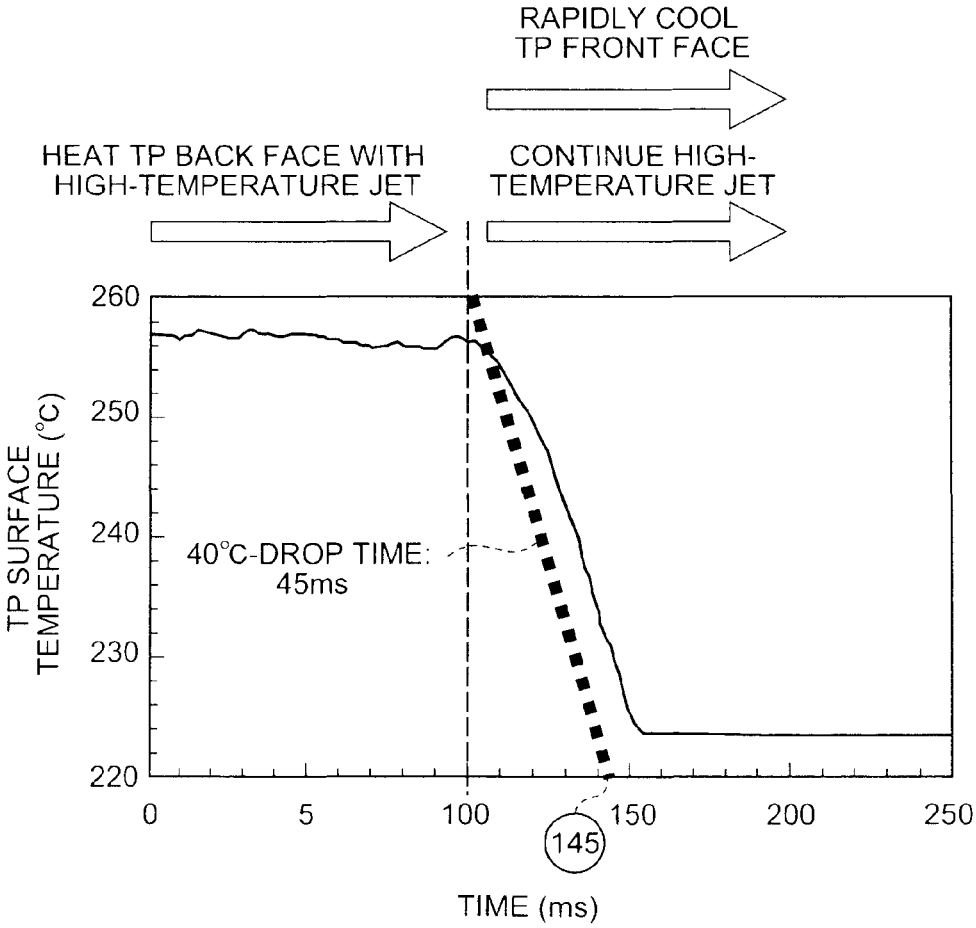
FIG. 8B is a graph that shows a cooling curve based on the result of the cooling test and a 40° C.-drop time that is derived from the cooling curve.

As shown in FIG. 8A, the outline of the swing characteristic evaluation test is as follows. A test piece TP in which the anodic oxide film was applied to one-side face is used. The entire test piece TP is stabilized at about 250° C. by heating the back face (a face to which no anodic oxide film is applied) with high-temperature air jet at 750° C. ("Heat" in the drawing), a nozzle through which room-temperature jet has been flowing in advance at a predetermined flow rate is moved by a linear motor to in front of the front face (a face to which the anodic oxide film is applied) of the test piece TP, and then cooling is started (this is to provide 25° C. cooling air ("Air" in the drawing), and high-temperature air jet toward the back face is continued at this time). The temperature of the surface of the anodic oxide film of the test piece TP is measured by a radiation thermometer provided outside, a decrease in the temperature at the time of cooling is measured, and the cooling curve shown in FIG. 8B is created. The cooling test is a test method that simulates the inner wall of the combustion chamber in intake stroke, and is to evaluate the rate of cooing at the heated surface of the heat insulation film. In the case of a heat insulation film having a low thermal conductivity and a low thermal capacity, the rate of rapid cooling tends to increase.

A time required to decrease by 40° C. is read from the created cooling curve, and the heat characteristic of the film is evaluated as a 40° C.-drop time.

Figure 9:
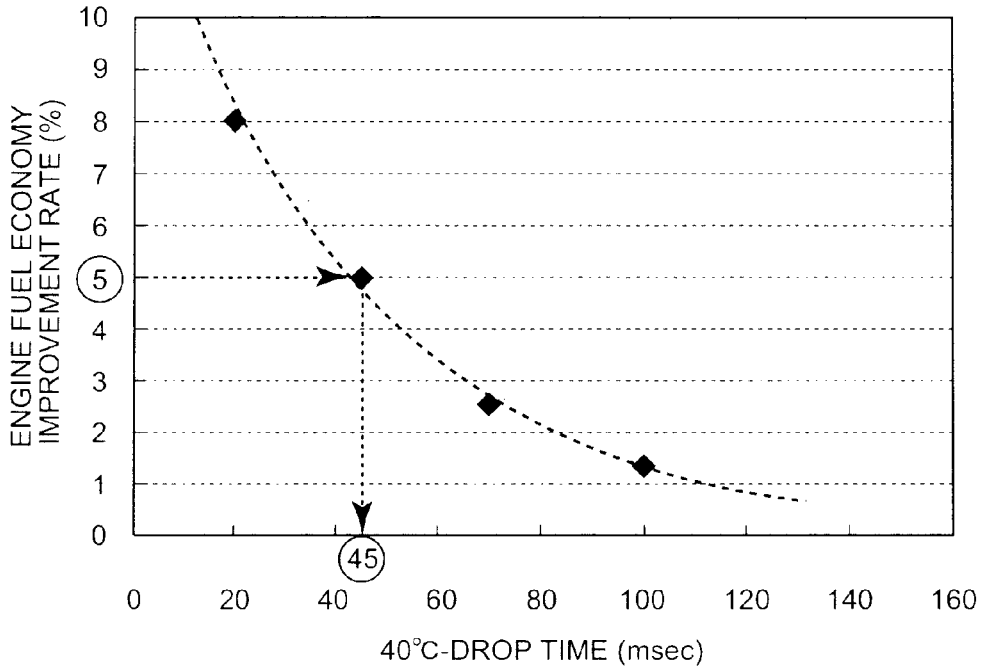
FIG. 9 is a correlation graph between a fuel economy improvement rate and a 40° C.-drop time in the cooling test.

On the other hand, according to the inventors, at the time of an experiment, a fuel economy improvement rate of 5% is set as a target value that is achieved by the capability of the anodic oxide film that constitutes the combustion chamber of the internal combustion engine according to the invention. The fuel economy improvement rate of 5% is set as a value that is able to clearly prove improvement in fuel economy and that is not buried as a measurement error and it is possible to reduce NOx by reducing a warm-up time of a NOx reduction catalyst with an increase in exhaust gas temperature. FIG. 9 shows a correlation graph between a fuel economy improvement rate and a 40° C.-drop time in the cooling test, which is identified by the inventors.

According to, the graph, the 40° C.-drop time in the cooling test, corresponding to the fuel economy improvement rate of 5%, is identified as 45 msec, and 45 msec or shorter may be set as an index indicating an excellent swing characteristic.

On the other hand, a micro-Vickers hardness test was employed as the strength test, an evaluation portion was set to the center portion of the anodic oxide film in cross section, and a loaded load was set to 0.025 kg. In measuring the density of the anodic oxide film of the test piece TP, the density of the entire film was measured in accordance with JIS H8688, the porosity of the nanopores was measured by Autosorb, and the porosity of the micropores was obtained by subtracting the porosity of the nanopores from a total porosity calculated from the density. The test result is shown in FIG. 10.

Figure 10:
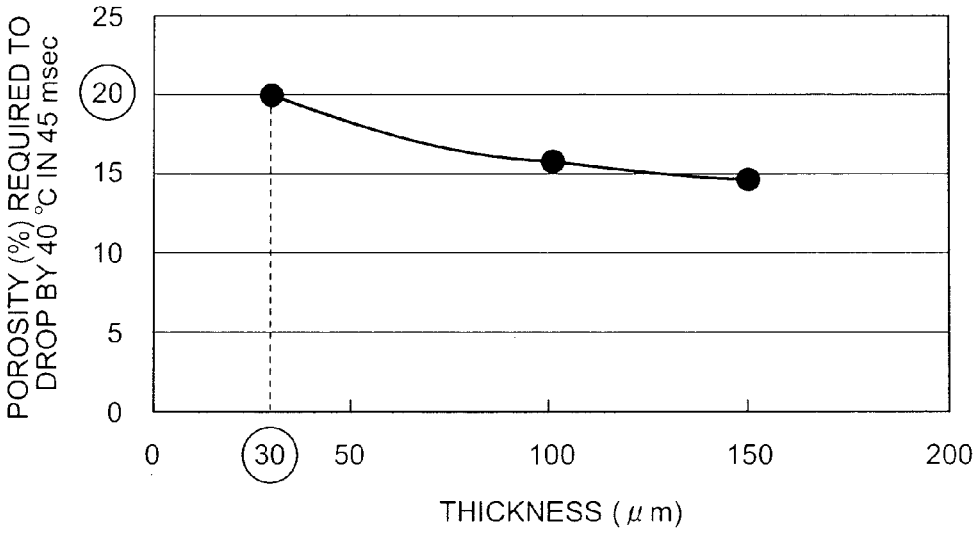
FIG. 10 is a graph that shows the test result regarding the correlation between a 45 msec achievement porosity and the thickness of the anodic oxide film.

From FIG. 10, the porosity of the anodic oxide film, which satisfies the 40° C.-drop time of 45 msec, is 20% for 30 μm thickness of the anodic oxide film. As the thickness increases, the porosity of the anodic oxide film, which satisfies the 40° C.-drop time of 45 msec, decreases.

According to this result, the anodic oxide film that constitutes the internal combustion engine according to the invention has a thickness of 30 μm or larger, so the porosity may be defined as 20% or higher.

Figure 11:
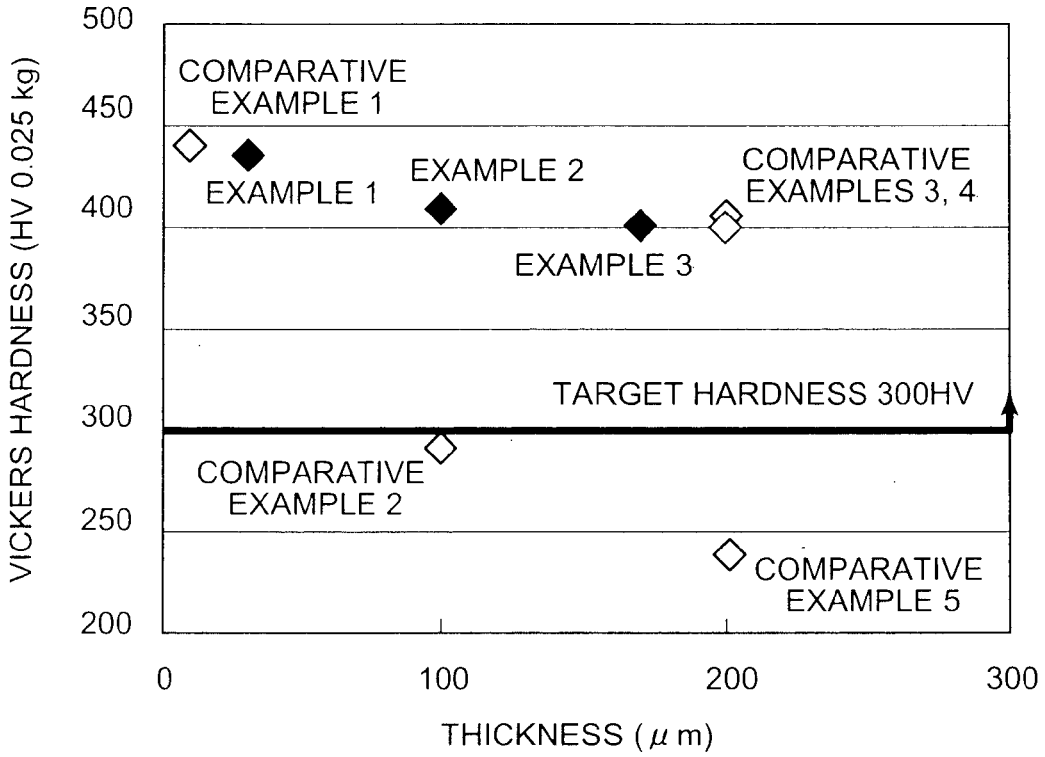
FIG. 11 is a graph that shows the test result regarding the correlation between the thickness of the anodic oxide film and a Vickers hardness.
Figure 12:
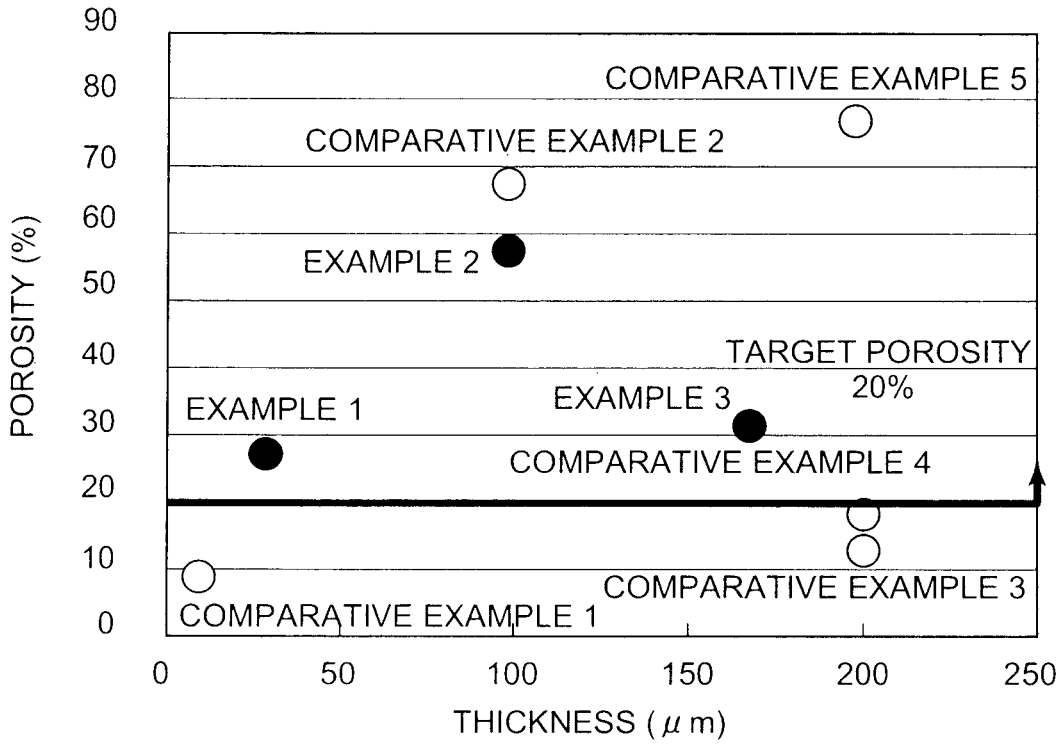
FIG. 12 is a graph that shows the result of experiment regarding the correlation between the thickness and porosity of the anodic oxide film.
Figure 13A:
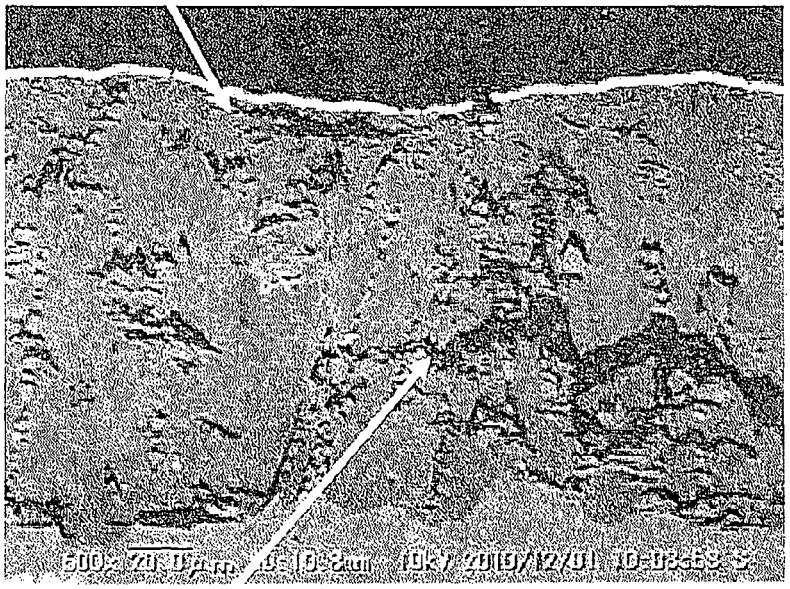
FIG. 13A is an SEM photograph showing the cross-sectional view of Example 2.
Figure 13B:
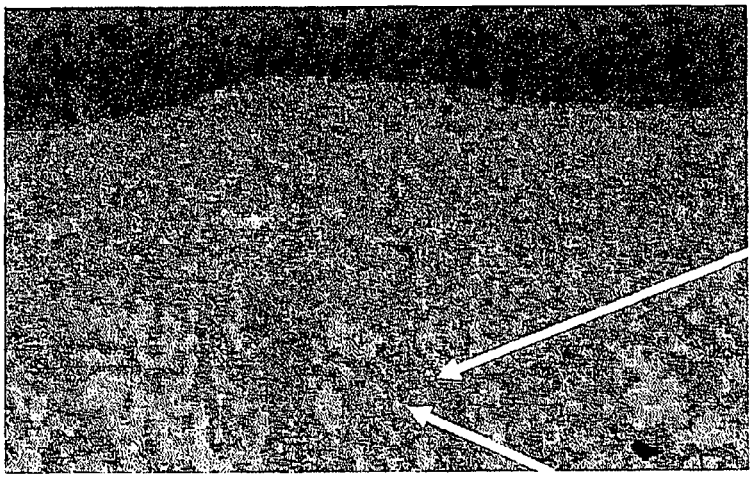
FIG. 13B is an SEM photograph showing the cross-sectional view of Comparative Example 3.
Figure 14A:
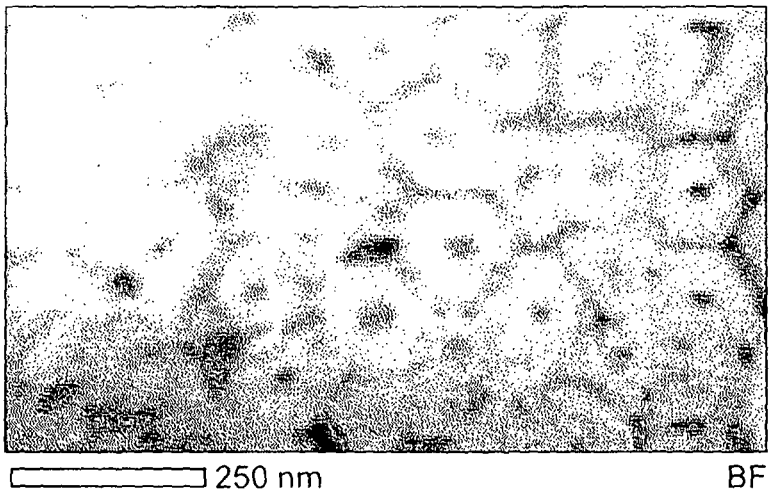
FIG. 14A is a TEM photograph showing the plan view of Example 2.
Figure 14B:
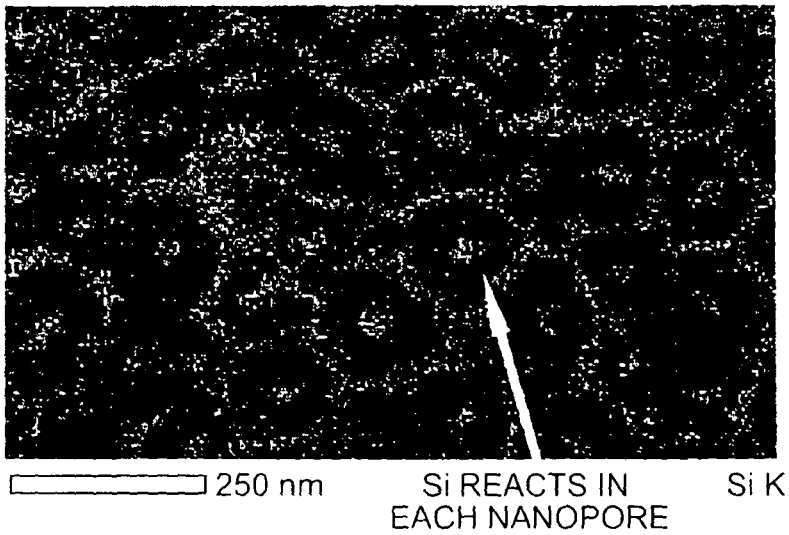
FIG. 14B is an EDX analysis view of the plan view of Example 2.

Hereinafter, the results of the specifications, porosity, Vickers hardness, and the like, of each of test pieces according to Comparative Examples 1 to 5 and Examples 1 to 3 are shown in Table 3. FIG. 11 shows the test results regarding the correlation between the thickness and Vickers hardness of each anodic oxide film. FIG. 12 shows the test results regarding the correlation between the thickness and porosity of each anodic oxide film. FIG. 13A is an SEM photograph of the cross-sectional view of Example 2. FIG. 13B is an SEM photograph of the cross-sectional view of Comparative Example 3. FIG. 14A is a TEM photograph of the plan view of Example 2. FIG. 14B is an EDX analysis view of the plan view of Example 2.

TABLE 3

| | Thickness of Anodic Oxide Film (μm) | Type of Alloy | Cu Content (%) | Si Content (%) | Sealant | Sealed Pores | Porosity (%) |
|---|---|---|---|---|---|---|---|
| Comparative Example 1 | 10 | Alloy 4 | 0.8 | 12 | Applied | Not-applied | 9 |
| Example 1 | 30 | Alloy 4 | 0.8 | 12 | Applied | Not-applied | 27 |
| Example 2 | 100 | Alloy 4 | 0.8 | 12 | Applied | Not-applied | 58 |
| Comparative Example 2 | 100 | Alloy 4 | 0.8 | 12 | Applied | Applied | 67 |
| Example 3 | 170 | Alloy 4 | 0.8 | 12 | Applied | Not-applied | 31 |
| Comparative Example 3 | 200 | Alloy 4 | 0.8 | 12 | Applied | Not-applied | 13 |
| Comparative Example 4 | 200 | Alloy 4 | 0.8 | 12 | Applied | Applied | 18 |
| Comparative Example 5 | 200 | Alloy 4 | 0.8 | 12 | Not-applied | Applied | 77 |

| | Vickers Hardness | Porosity (%) of Anodic Oxide Film | | | |
|---|---|---|---|---|---|
| | | Before Application of Sealant | | After Application of Sealant | |
| | (HV 0.025 kg) | Micropores | Nanopores | Micropores | Nanopores |
| Comparative Example 1 | 430 | 3 | 15 | 2 | 7 |
| Example 1 | 425 | 22 | 15 | 20 | 7 |
| Example 2 | 410 | 55 | 16 | 50 | 7.5 |
| Comparative Example 2 | 290 | 55 | 16 | 51 | 16 |
| Example 3 | 401 | 61 | 16 | 23 | 8 |
| Comparative Example 3 | 405 | 61 | 15 | 6 | 7 |
| Comparative Example 4 | 400 | 61 | 16 | 4 | 14 |
| Comparative Example 5 | 230 | 61 | 16 | 61 | 16 |

According to Table 3, FIG. 11 and FIG. 12, in each of Examples 1 to 3, the Vickers hardness is higher than or equal to 300 HV that is a target value, and the porosity also satisfies 20% or higher.

It has been demonstrated that, in Comparative Example 5 in which no sealant is provided or Comparative Example 2 in which no sealant is impregnated in the anodic oxide film, the hardness of each anodic oxide film is low, and the hardness of each anodic oxide film is ensured because of the fact that the sealant seals the first micropores and the nanopores.

In addition, it has been demonstrated by Comparative Example 1 that the porosity of 20% or higher cannot be achieved when the thickness of the anodic oxide film is smaller than 30 μm and, as a result, an excellent swing characteristic in the case where the 40° C.-drop time is shorter than or equal to 45 msec is not satisfied.

Furthermore, it has been demonstrated from FIG. 13B that longitudinal cracks are promoted when the thickness of the anodic oxide film exceeds 170 μm, the longitudinal cracks communicate with the internal defects present inside the film, the sealant applied to the surface layer of the anodic oxide film is impregnated into the internal defects and seals the internal defects, with the result that the porosity decreases. It has been confirmed from the EDX analysis view of Example 2 shown in FIG. 14B that Si react in each of the nanopores and polysilazane that is the sealant is impregnated.

Figure 15:
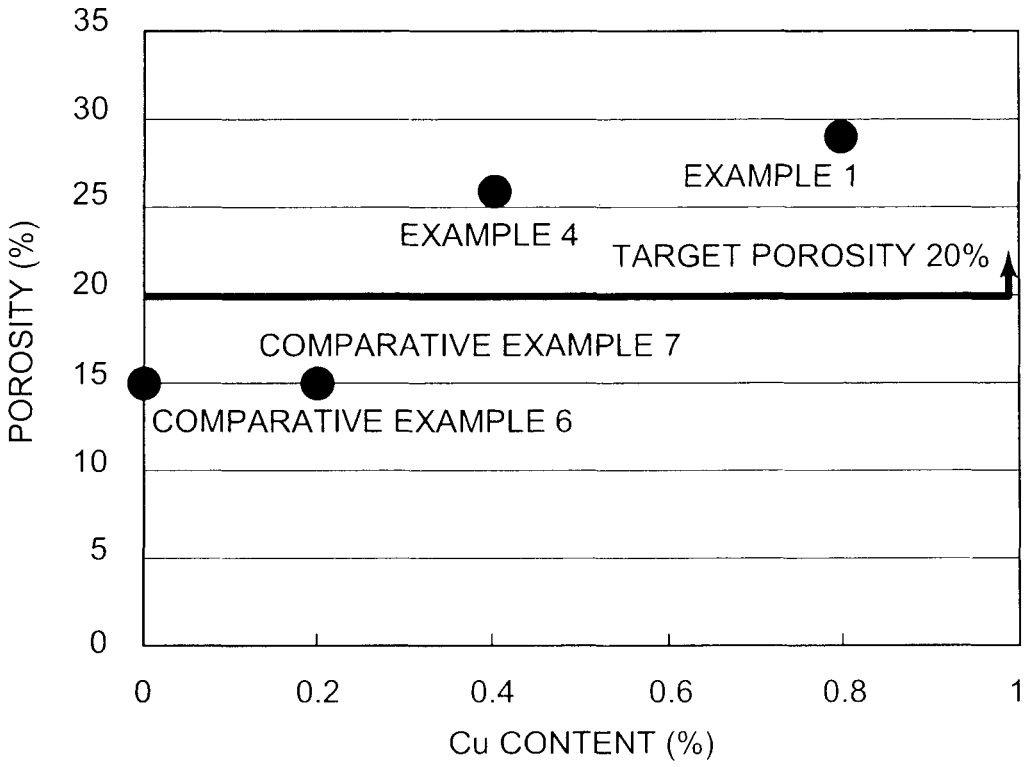
FIG. 15 is a graph that shows the test result regarding the correlation between the amount of Cu and a porosity in a material forming an aluminum-based wall surface.
Figure 16:
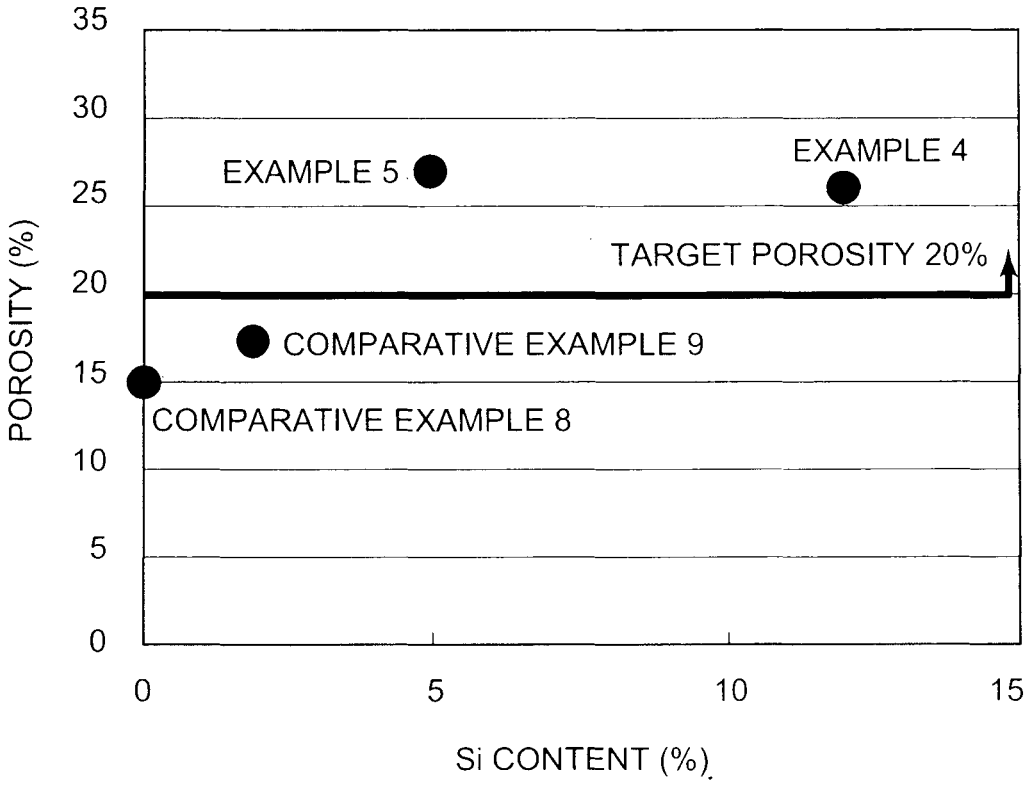
FIG. 16 is a graph that shows the test result regarding the correlation between the amount of Si and a porosity in the material forming the aluminum-based wall surface.
Figure 17A:
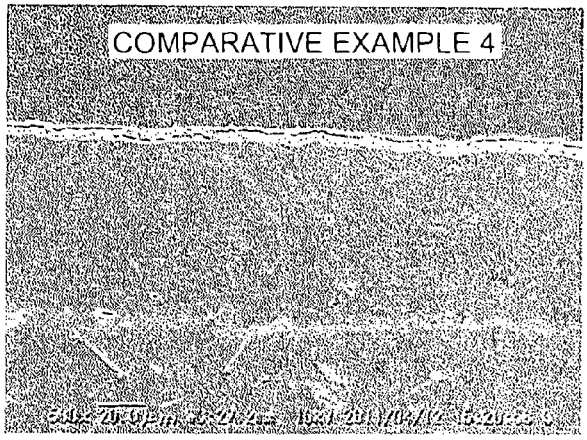
FIG. 17A is an SEM photograph showing the cross-sectional view of Comparative Example 4.
Figure 17B:
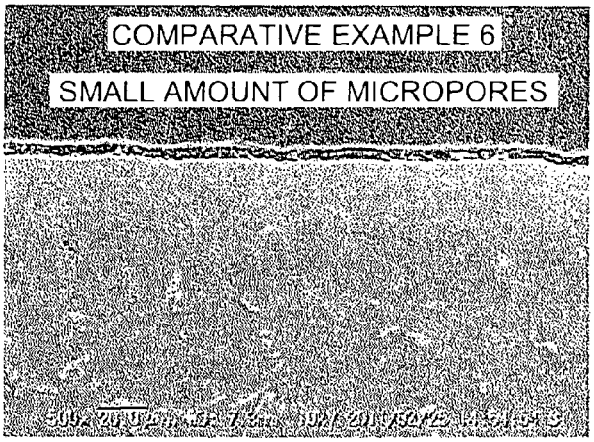
FIG. 17B is an SEM photograph showing the cross-sectional view of Comparative Example 6.
Figure 17C:
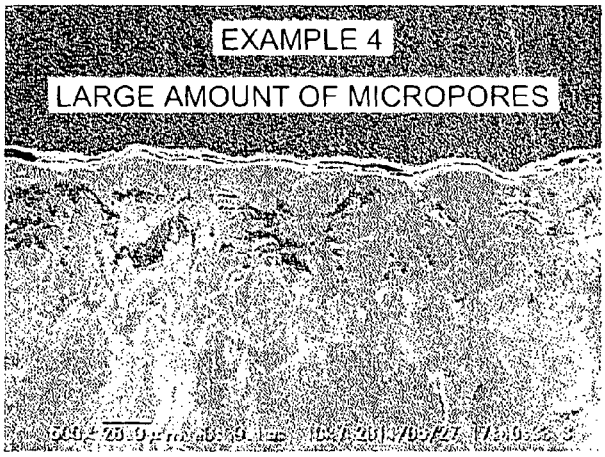
FIG. 17C is an SEM photograph showing the cross-sectional view of Example 4.

Next, the test result that identifies the correlation among a Cu content and an Si content in each alloy and a porosity is shown. The following Table 4 shows the specifications, porosity, Vickers hardness, and the like, of each of test pieces according to Examples 1, 4, 5 and Comparative Examples 6 to 9. FIG. 15 is a graph that shows the test result regarding the correlation between a Cu content and a porosity in the material of forming the aluminum-based wall surface. FIG. 16 is a graph that shows the test result regarding an Si content and a porosity in the material of forming the aluminum-based wall surface. FIG. 17A, FIG. 17B and FIG. 17C are respectively SEM photographs of the cross-sectional views of Comparative Example 4, Comparative Example 6 and Example 4.

TABLE 4

| | Thickness of Anodic Oxide Film (μm) | Type of Alloy | Cu Content (%) | Si Content (%) | Sealant | Sealed Pores | Porosity (%) |
|---|---|---|---|---|---|---|---|
| Comparative Example 6 | 30 | Alloy 1 | 0 | 12 | Applied | Not-applied | 15 |

TABLE 4-continued

| | | | | | | | |
|---|---|---|---|---|---|---|---|
| Comparative Example 7 | 30 | Alloy 2 | 0.2 | 12 | Applied | Not-applied | 15 |
| Example 4 | 30 | Alloy 3 | 0.4 | 12 | Applied | Not-applied | 26 |
| Example 1 | 30 | Alloy 4 | 0.8 | 12 | Applied | Not-applied | 27 |
| Comparative Example 8 | 30 | Alloy 5 | 0.4 | 0 | Applied | Not-applied | 15 |
| Comparative Example 9 | 30 | Alloy 6 | 0.4 | 2 | Applied | Not-applied | 17 |
| Example 5 | 30 | Alloy 7 | 0.4 | 5 | Applied | Not-applied | 27 |

| | Vickers Hardness | Porosity (%) of Anodic Oxide Film | | | |
|---|---|---|---|---|---|
| | | Before Application of Sealant | | After Application of Sealant | |
| | (HV 0.025 kg) | Micropores | Nanopores | Micropores | Nanopores |
| Comparative Example 6 | 420 | 8 | 15 | 8 | 7 |
| Comparative Example 7 | 415 | 8 | 15 | 8 | 7 |
| Example 4 | 410 | 19 | 15 | 19 | 7 |
| Example 1 | 425 | 22 | 15 | 20 | 7 |
| Comparative Example 8 | 423 | 8 | 15 | 8 | 7 |
| Comparative Example 9 | 410 | 10 | 15 | 10 | 7 |
| Example 5 | 430 | 20 | 15 | 20 | 7 |

It has been demonstrated from the test that film formation of 100 μm or larger is not possible because Si interferes with film growth in the case where the Si content is higher than or equal to 20%, and film formation of 100 μm or larger is not possible because micropores enlarge due to gas that is generated at Cu in the case where the Cu content is higher than or equal to 7% and it is difficult to form the film.

It has been demonstrated from Table 4 and FIG. 15 that it is possible to enlarge the micropores when the Cu content is higher than or equal to 0.4% and it is possible, to ensure a desired porosity (20% or higher).

It has been demonstrated from Table 4 and FIG. 16 that it is possible to enlarge the micropores when the Si content is higher than or equal to 5% and it is possible to ensure a desired porosity (20% or higher).

It appears from FIG. 17A to FIG. 17C that almost no micropores are present in Comparative Example 4 and a slight amount of micropores are present in Comparative Example 6; whereas a large amount of micropores are present in Example 4, and it is possible to ensure a high porosity.

The embodiment of the invention is described in detail with reference to the accompanying drawings; however, a specific configuration is not limited to the embodiment. The invention also encompasses design changes, and the like, without departing from the scope of the invention.

The invention claimed is:

1. An internal combustion engine comprising:

an anodic oxide film forming on part or all of an aluminum-based wall surface facing a combustion chamber, wherein an aluminum-based material that forms the aluminum-based wall surface contains Si and Cu as an alloy component, a content of Si in the aluminum-based material is higher than or equal to 5% and less than 20% and a content of Cu in the aluminum-based material is higher than or equal to 0.4% and less than 7%, the anodic oxide film has a thickness of 30 μm to 170 μm;

the anodic oxide film has first micropores having a micro-size diameter, nanopores having a nano-size diameter and second micropores having a micro-size diameter, the first micropores and second micropores have a sectional diameter or maximum size of a range of 1 to 100 μm and the nanopores have a sectional diameter or maximum size of a range of 10 to 100 nm, the first micropores and the nanopores extending from a surface of the anodic oxide film toward an inside of the anodic oxide film in a thickness direction of the anodic oxide film or substantially the thickness direction, the second micropores being provided inside the anodic oxide film;

the first micropores are cracks extending from the surface of the anodic oxide film to the inside of the anodic oxide film;

the second micropores are internal defects not present at the surface of the anodic oxide film but present inside the film;

the nanopores are originated from anodizing and are regularly arranged;

at least part of the first micropores and the nanopores are sealed with a seal that is converted from a sealant, at least part of the second micropores are not sealed; and the anodic oxide film sealed with the seal has a porosity of 20 to 70%.

2. The internal combustion engine according to claim 1, wherein the seal is made of a substance that includes silica as a main component.

3. The internal combustion engine according to claim 1, wherein the sealant is made of any one of polysiloxane, polysilazane and sodium silicate.

4. The internal combustion engine according to claim 1, wherein the aluminum-based material that forms the aluminum-based wall surface further contains at least one of Mg, Ni, and Fe as the alloy component.

5. A manufacturing method for an internal combustion engine, comprising:

a first step of forming an anodic oxide film on part or all of an aluminum-based wall surface facing a combustion chamber, the anodic oxide film having first micropores having a micro-size diameter, nanopores having a nano-size diameter and second micropores having a micro-size diameter, the first micropores and second micropores having a sectional diameter or maximum size of a range of 1 to 100 μm and the nanopores having a sectional diameter or maximum size of a range of 10 to 100 nm, the first micropores and the nanopores extending from a surface of the anodic oxide film toward an inside of the anodic oxide film in a thickness direction of the anodic oxide film or substantially the thickness direction, the second micropores being provided inside the anodic oxide film, the anodic oxide film having a thickness of 30 μm to 170 μm; and a second step of forming the anodic oxide film subjected to sealing in which a sealant is applied to the surface of the anodic oxide film, the sealant penetrates into at least part of the first micropores and the nanopores, the sealant is converted into a seal, at least part of the first micropores and the nanopores are sealed with the seal and at least part of the second micropores are not sealed, wherein an aluminum-based material that forms the aluminum-based wall surface contains Si and Cu as an alloy component, a content of Si in the aluminum-based material is higher than or equal to 5% and less than 20% and a content of Cu in the aluminum-based material is higher than or equal to 0.4% and less than 7%; and the anodic oxide film sealed with the seal has a porosity of 20 to 70%.

6. The manufacturing method according to claim 5, wherein the seal is made of a substance that includes silica as a main component.

7. The manufacturing method according to claim 5, wherein the sealant is made of any one of polysiloxane, polysilazane and sodium silicate.

8. The manufacturing method according to claim 5, wherein the aluminum-based material that forms the aluminum-based wall surface further contains at least one of Mg, Ni, and Fe as the alloy component.

* * * * *